US011850863B2

(12) United States Patent
Nishimoto et al.

(10) Patent No.: US 11,850,863 B2
(45) Date of Patent: Dec. 26, 2023

(54) IMAGE RECORDING APPARATUS, METHOD FOR IMAGE RECORDING, AND COMPUTER-READABLE STORAGE MEDIUM

(71) Applicant: BROTHER KOGYO KABUSHIKI KAISHA, Nagoya (JP)

(72) Inventors: Takahiro Nishimoto, Ogaki (JP); Akihiro Kobayashi, Yokkaichi (JP); Kenta Hasebe, Nagoya (JP); Kengo Takeda, Tokai (JP); Yumiko Oshika, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 132 days.

(21) Appl. No.: 17/590,815

(22) Filed: Feb. 1, 2022

(65) Prior Publication Data

US 2022/0242131 A1 Aug. 4, 2022

(30) Foreign Application Priority Data

Feb. 2, 2021 (JP) ..... 2021-015084

(51) Int. Cl.
*B41J 2/17* (2006.01)
*B41J 2/045* (2006.01)
*B41J 2/21* (2006.01)

(52) U.S. Cl.
CPC ..... *B41J 2/1721* (2013.01); *B41J 2/0456* (2013.01); *B41J 2/04535* (2013.01); (Continued)

(58) Field of Classification Search
CPC .. B41J 2/04556; B41J 2/0456; B41J 2/04516; B41J 2/04535; B41J 2/1714; B41J 2/1721; B41J 2002/1742; B41J 29/38
See application file for complete search history.

(56) References Cited

U.S. PATENT DOCUMENTS 6,220,693 B1 * 4/2001 Bode ..... B41J 2/04586 347/34
2017/0190182 A1 * 7/2017 Suzuki ..... B41J 29/38
(Continued)

FOREIGN PATENT DOCUMENTS

JP 2004-330637 A 11/2004
JP 2006-192704 A 7/2006
(Continued)

OTHER PUBLICATIONS

Goto, Machine TranslationofJP-2015067931-A, 2015 (Year: 2015).*

*Primary Examiner* — Scott A Richmond
(74) *Attorney, Agent, or Firm* — KENEALY VAIDYA LLP

(57) ABSTRACT

An image recording apparatus, having a discharging head, a fan, and a controller, is provided. The discharging head includes a discharging surface and a plurality of nozzles arranged along a sub-scanning direction, which intersects orthogonally with a main scanning direction. The discharging head is configured to move in the main scanning direction. The fan is configured to generate an airflow for collecting mist of ink discharged through the nozzles. The controller is configured to obtain a droplet size of the ink to be discharged through the nozzles from one of a print job and a printing mode set in advance, obtain a distance between the discharging surface and a printable medium, and control a rotation speed of the fan based on the droplet size and the distance.

18 Claims, 14 Drawing Sheets

(52) U.S. Cl.
CPC ..... *B41J 2/04556* (2013.01); *B41J 2/1714* (2013.01); *B41J 2/04581* (2013.01); *B41J 2/2114* (2013.01); *B41J 2002/1742* (2013.01)

(56) References Cited

U.S. PATENT DOCUMENTS

| | | | | |
|---|---|---|---|---|
| 2018/0043685 | A1 | 2/2018 | Sakurada et al. | |
| 2020/0122468 | A1 * | 4/2020 | Takahashi | B41J 2/1714 |

FOREIGN PATENT DOCUMENTS

| | | | | | |
|---|---|---|---|---|---|
| JP | 2009-101663 | A | | 5/2009 | |
| JP | 2015067931 | A | * | 4/2015 | B41J 11/0095 |
| JP | 2016-175288 | A | | 10/2016 | |
| JP | 2017-177531 | A | | 10/2017 | |

* cited by examiner

IMAGE RECORDING APPARATUS, METHOD FOR IMAGE RECORDING, AND COMPUTER-READABLE STORAGE MEDIUM

CROSS REFERENCE TO RELATED APPLICATION

This application claims priority under 35 U.S.C. § 119 from Japanese Patent Application No. 2021-015084, filed on Feb. 2, 2021, the entire subject matter of which is incorporated herein by reference.

BACKGROUND

The present disclosure is related to an image recording apparatus, such as, for example, but not necessarily limited to, an inkjet printer, a method for recording an image with the image recording apparatus, and a computer-readable storage medium storing computer readable instructions for recording an image.

In an image recording apparatus such as an inkjet printer, an action of a discharging head to discharge ink droplets through nozzles may generate minute particles of the ink called mist, which are unnecessary for image recording. In this regard, an image recording apparatus equipped with a mist-collecting mechanism to suction and collect the mist is known. With regard to the known image recording apparatus, for example, it is known that, when an airflow velocity is 400 cm/s or higher, not only the minute ink particles, but also ink droplets with a particle diameter of 10 μm or larger, which are intended to land vertically on a printable medium, may be caught in the airflow and may cause disruption in the image recording. On the other hand, it is also known that, when the airflow velocity is smaller than 1 cm/s, ink particles with a particle diameter of 5 μm or smaller in the mist may not be collected. Therefore, in order to provide a preferable image recording condition, it is suggested that the mist-collecting mechanism may generate an airflow in a velocity between 1 cm/s and 400 cm/s.

SUMMARY

Meanwhile, the inventors of the present disclosure have discovered based on experiments that, when a distance between a discharging head and a printable medium, or a distance between the discharging head and a platen, is large, small and slow droplets may be slowed down even more by air resistance and float in the air without reaching the printable medium. In this regard, it may be suggested that larger and faster ink droplets are discharged; however, when larger and faster droplets are discharged consecutively, the droplets may form a line of trailing ink. The line of trailing ink may break into pieces before landing on the printable medium, and the pieces may gather again to form droplets in different sizes. Among the droplets in different sizes, smaller droplets may tend to float as mist. Thus, when the size of the discharged droplets is larger, the mist may more likely be generated. The generated mist may adhere to the printable medium and may lower a quality of image recording.

The present disclosure is advantageous in that an image recording apparatus, a method for recording an image, and a computer-readable storage medium storing computer-readable instructions for recording an image, by which mist may be collected efficiently and image recording quality may be restrained from lowering, are provided.

According to an aspect of the present disclosure, an image recording apparatus, having a discharging head, a fan, and a controller, is provided. The discharging head includes a discharging surface and a plurality of nozzles arranged along a sub-scanning direction, which intersects orthogonally with a main scanning direction. The discharging head is configured to move in the main scanning direction. The fan is configured to generate an airflow for collecting mist of ink discharged through the nozzles. The controller is configured to obtain a droplet size of the ink to be discharged through the nozzles from one of a print job and a printing mode set in advance, obtain a distance between the discharging surface and a printable medium, and control a rotation speed of the fan based on the droplet size and the distance.

According to another aspect of the present disclosure, a method for recording an image in an image recording apparatus having a discharging head including a discharging surface is provided. The method includes operating the discharging head to move and discharge ink, operating a fan to generate an airflow for collecting mist of the ink discharged from the discharging head, obtaining a droplet size of the ink to be discharged from the discharging head from one of a print job and a printing mode set in advance, obtaining a distance between the discharging surface and a printable medium, and controlling a rotation speed of the fan based on the droplet size and the distance.

According to another aspect of the present disclosure, a non-transitory computer readable storage medium storing computer readable instructions that are executable by a computer configured to control an image recording apparatus is provided. The image recording apparatus has a discharging head and a fan. The discharging head includes a discharging surface and a plurality of nozzles arranged along a sub-scanning direction, which intersects orthogonally with a main scanning direction. The discharging head is configured to move in the main scanning direction. The fan is configured to generate an airflow for collecting mist of ink discharged through the nozzles. The computer readable instructions, when executed by the computer, cause the computer to obtain a droplet size of the ink to be discharged through the nozzles from one of a print job and a printing mode set in advance, obtain a distance between the discharging surface and a printable medium, and control a rotation speed of the fan based on the droplet size and the distance.

BRIEF DESCRIPTION OF THE DRAWINGS

6B illustrates the distance between the platen and the nozzles being a middle gap in the image recording apparatus according to the embodiment of the present disclosure.

DETAILED DESCRIPTION

In the following paragraphs, with reference to the accompanying drawings, an embodiment of the present disclosure will be described. It is noted that an image recording apparatus described below is merely one embodiment of the present disclosure, and various connections may be set forth between elements in the following description. These connections in general and, unless specified otherwise, may be direct or indirect and that this specification is not intended to be limiting in this respect.

Figure 1:
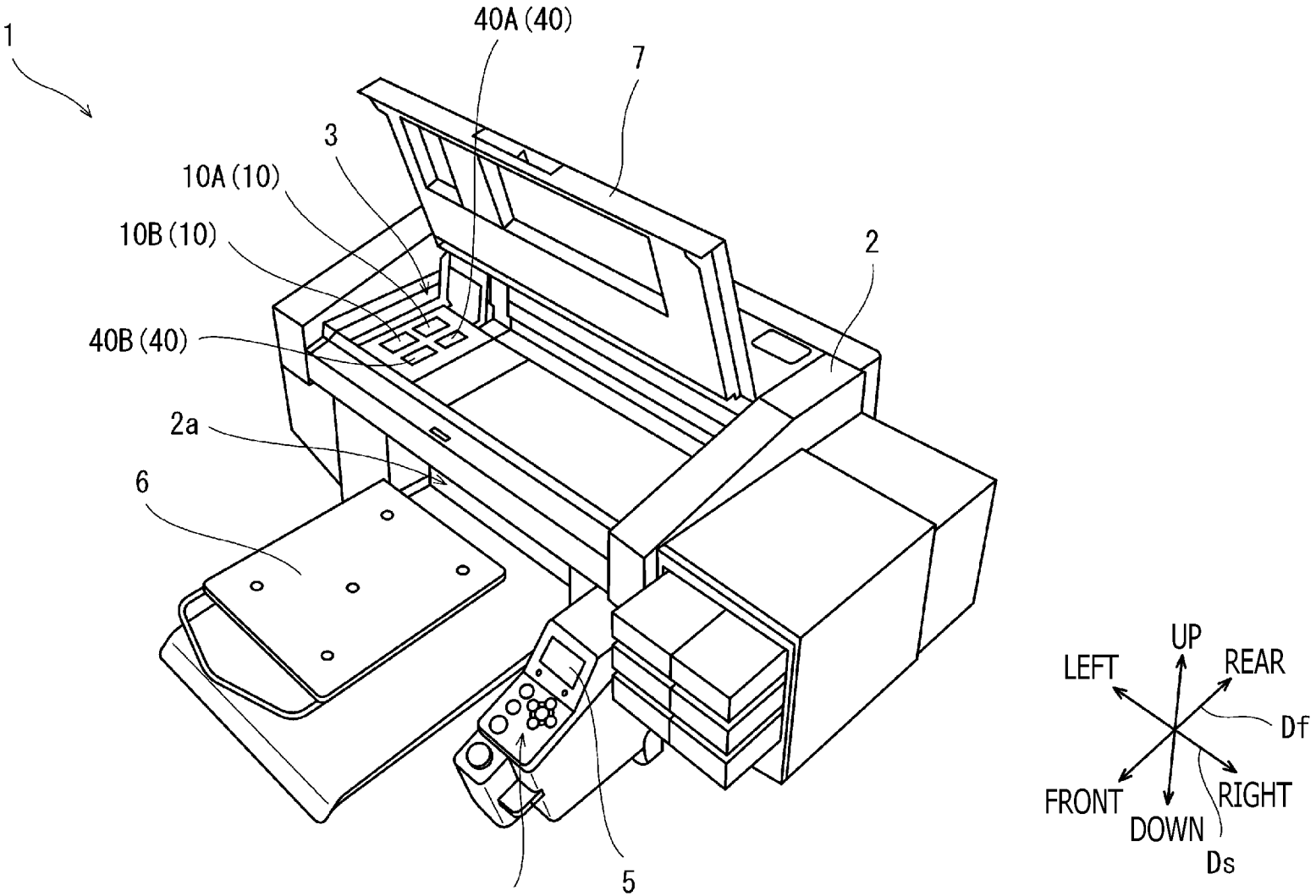
FIG. 1 is a perspective view of an image recording apparatus according to an embodiment of the present disclosure.

FIG. 1 is a perspective view of an image recording apparatus 1 according to the embodiment of the present disclosure. In the following description, directions in three (3) dimensions intersecting orthogonally to one another may be called as a vertical direction, a widthwise direction, and a front-rear direction, as indicated by bidirectionally pointing allows shown in FIG. 1. The widthwise direction may also be called as a main scanning direction Ds, and the front-rear direction may also be called as a sub-scanning direction Df. The image recording apparatus 1 may print images not only on printable media W such as sheets but also on printable media W being goods, such as resin products.

As shown in FIG. 1, the image recording apparatus 1 in the present embodiment has a housing 2, operation keys 4, a display 5, a platen 6, on which a printable medium W is placed, and an upper cover 7. Moreover, the image recording apparatus 1 has an ink-discharging device 1*a* (see FIG. 2) and a controller 19 (see FIG. 5), which will be described further below.

The housing 2 has a form of a box. The housing 2 has an opening 2*a* on a front side thereof and an opening, which is not shown, on a rear side thereof. At rightward-front positions of the housing 2, the operation keys 4 are arranged. At a rearward position with respect to the operation keys 4, the display 5 is arranged. The operation keys 4 may accept operations input by a user. The display 5 may include, for example, a touch panel and may display predetermined types of information. A part of the display 5 may work as an operation key at a predetermined timing. The controller 19 may, based on input through the operation keys 4 or external input through a communication interface, which is not shown, perform printing and control the display 5 to display the information.

The platen 6 is configured to place the printable medium W thereon. The platen 6 has a predetermined thickness and includes a rectangular plate elongated in, for example, the sub-scanning direction Df. The platen 6 is supported removably by a platen-supporting stand, which is not shown. The platen-supporting stand is movable in the sub-scanning direction Df by driving a conveyer motor 33 (see FIG. 5) between a printing position, at which an image may be printed on the printable medium W, and a removable position, at which the printable medium W may be removed from the platen 6. The printable position is a position, at which the platen 6 faces a discharging head 10, which will be described further below, and the removable position is a position, at which the platen-supporting stand is located outside the housing 2 and at which the printable medium W may be set on the platen 6. While printing an image, the platen 6 moves in the sub-scanning direction Df; therefore, the printable medium W placed on the platen 6 is conveyed in the sub-scanning direction Df.

The upper cover 7 is pivotable upward by being lifted at a frontward part thereof. By pivoting the upper cover 7 upward, a cavity inside the housing 2 may be exposed.

Figure 2:
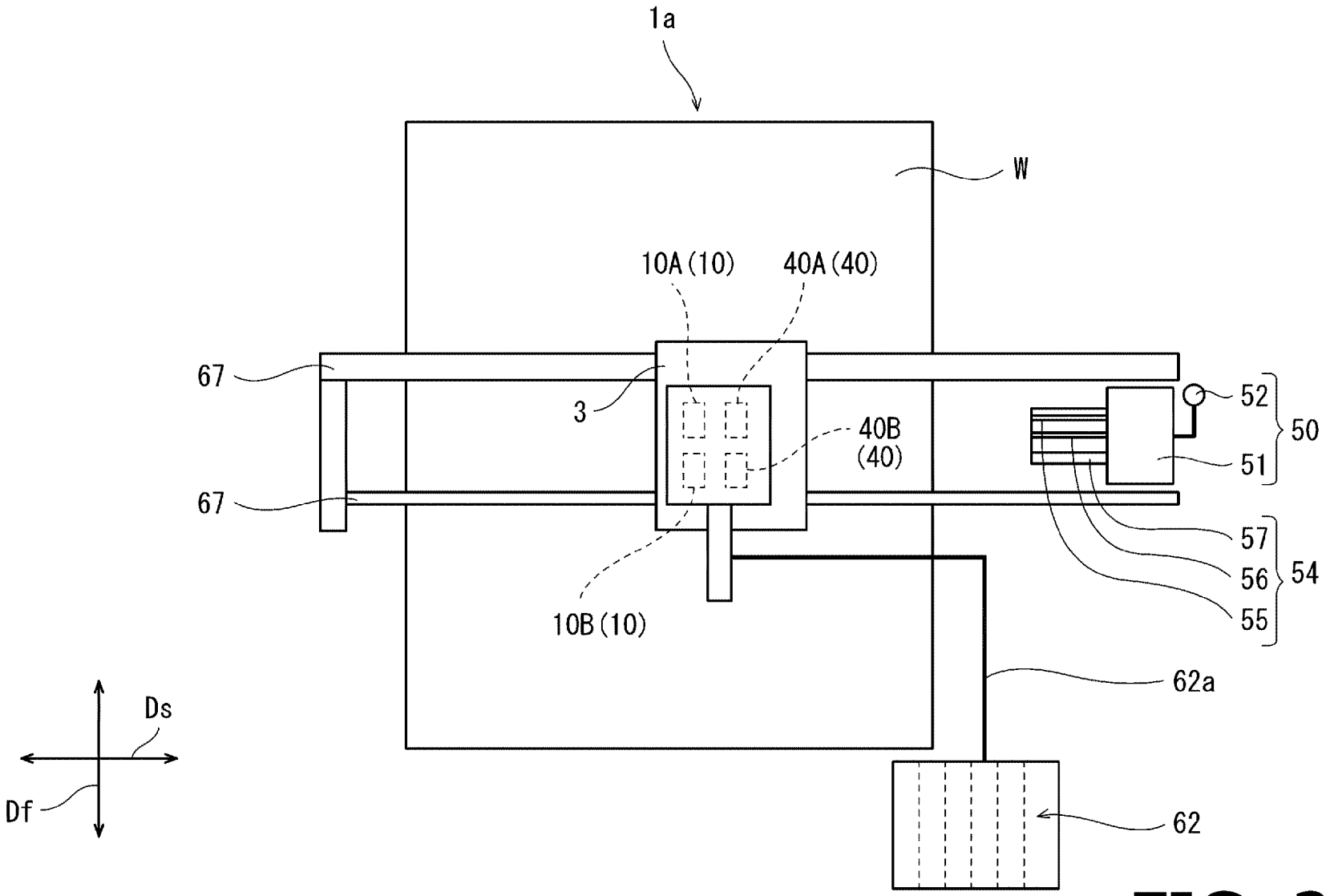
FIG. 2 is a plan view of an ink-discharging device in the image recording apparatus according to the embodiment of the present disclosure.

As shown in FIG. 2, the ink-discharging device 1*a* has reservoir tanks 62, a carriage 3, on which the discharging head 10 and an ultraviolet (UV) irradiation device 40 are mounted, and a pair of guide rails 67. The discharging head 10 includes two (2) discharging heads 10A, 10B, and the UV irradiation device 40 includes two (2) UV irradiation devices 40A, 40B. The discharging head 10 may be, for example, but not necessarily limited to, inkjet head that may discharge UV-curable ink. For another example, the discharging head 10 may discharge ink, which is not curable by UV but is curable by infrared.

The carriage 3 is supported by the pair of guide rails 67, which extend in the main scanning direction Ds, and may reciprocate in the main scanning direction Ds along the guide rails 67. Thereby, the discharging head, including the two discharging heads 10A, 10B, and the UV irradiation device 40, including the two UV irradiation devices 40A, 40B, may reciprocate in the main scanning direction Ds. The discharging heads 10A, 10B are connected with the reservoir tanks 62 through tubes 62*a*.

In the present embodiment, the discharging head 10A may discharge inks in colors of, for example, yellow (Y), magenta (M), cyan (C), and black (K), which may be generally called as color inks. With the inks in the four colors being discharged at the printable medium W, a multicolored image may be printed on the printable medium W. Meanwhile, the discharging head 10B may discharge a white (W) ink and a clear (Cr) ink. When, for example, a multicolored image is printed on a piece of fabric being the printable medium W, in order to reduce influence of a base color of the fabric on the image and influence by the color inks to the material of the fabric, the white ink may be discharged to form a base layer in advance, and the color inks may be discharged later on the white base. The clear ink may be discharged to apply glossy coating over the printed image or to protect the printed image.

The reservoir tanks 62 may store the inks. The reservoir tanks 62 and the inks are provided on one-to-one correspondence. For example, six (6) reservoir tanks 62 may be provided, and black, yellow, cyan, magenta, white, and clear inks may be stored in each one of the reservoir tanks 62.

The ink-discharging device 1*a* further includes a purge unit 50 and a wipe unit 54. The purge unit 50 and the wipe unit 54 are arranged on one end of the paired guide rails 67 in the main scanning direction Ds in an area, which overlaps a part of a movable range of the carriage 3.

The purge unit 50 includes a cap 51, a suction pump 52, and a lift assembly 53. The suction pump 52 is connected to the cap 51. The lift assembly 53 may lift and lower the cap between a suction position a standby position. At the standby position, a discharging surface NM (see FIG. 3) of the discharging head 10 is separated from the cap 51. At the suction position, the discharging surface NM is covered with the cap 51, and a space inside the discharging head 10 is sealed. When the cap 51 is located at the suction position, and when the suction pump 52 is activated, fluid in the inner space is suctioned, and the inks may be discharged through nozzle holes 121*a* (see FIG. 3), which will be described further below. Thus, a purging process to discharge the inks forcibly through the nozzles 121 may be performed.

The wipe unit 54 includes two (2) wipers 55, 56 and a movable assembly 57. The wipers 55, 56 are supported by the movable assembly 57. With the discharging surface NM located at a position to face the wipers 55, 56, the movable assembly 57 may move in the sub-scanning direction Df. Thus, the wipers 55, 56 may move in the sub-scanning direction Df and perform a wiping action to wipe the discharging surface NM.

Figure 3:
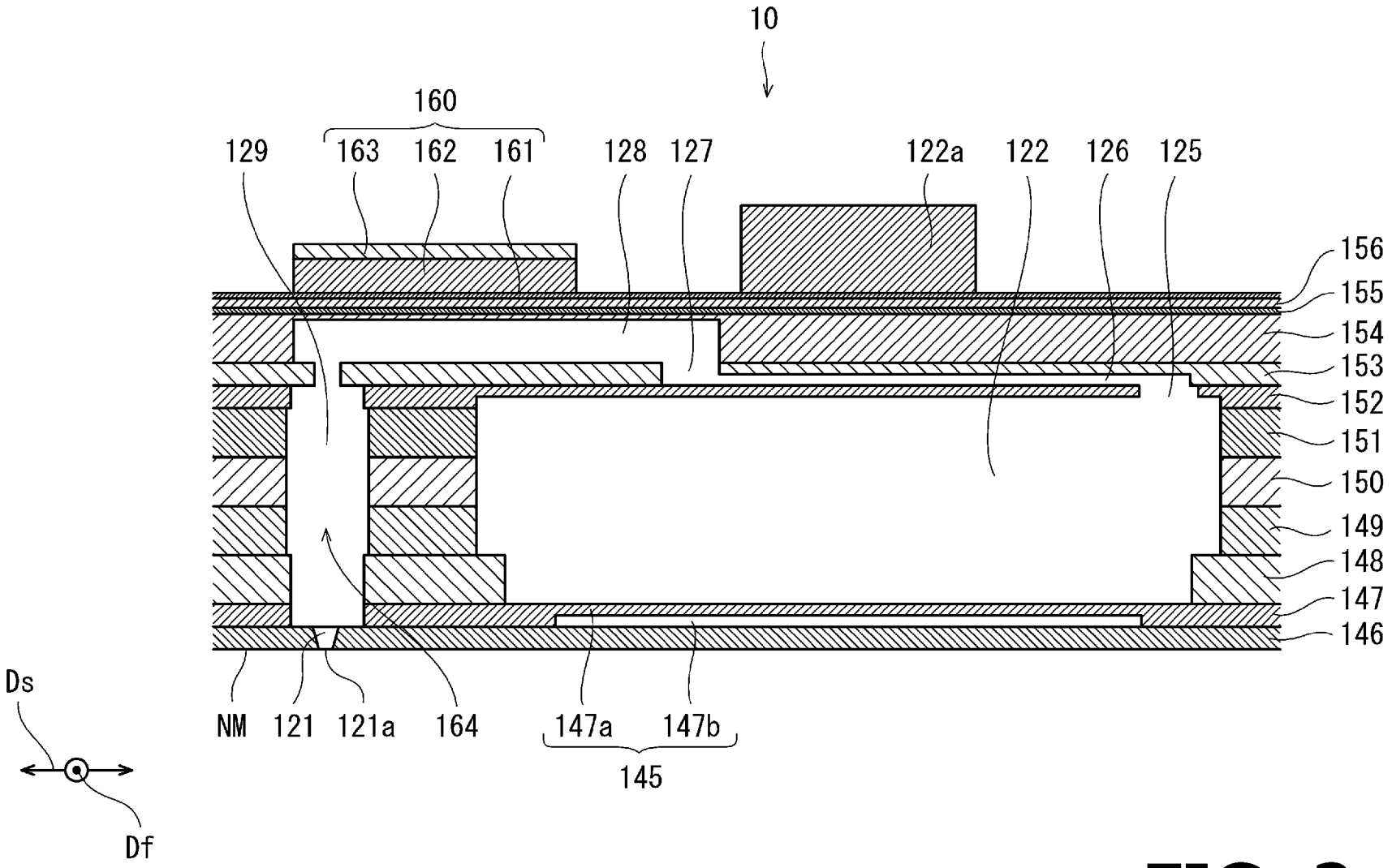
FIG. 3 is a cross-sectional view of a discharging head in the image recording apparatus according to the embodiment of the present disclosure.

As shown in FIG. 3, the discharging head 10 has a plurality of nozzles 121, which may discharge droplets of the ink in the reservoir tank 62. The discharging head 10 has a laminated formation including a flow-path part and volume-changeable part. In the flow-path part, an ink path is formed, and on the discharging surface NM being a lower face of the flow-path part, the plurality of nozzle holes 121*a* are formed. The volume-changeable part may be operated to change a volume of the path for the ink. When the volume of the ink path is changed, menisci formed in the nozzle holes 121*a* may vibrate, and the ink may be discharged. In the following paragraphs, configuration of the discharging head 10 including the discharging heads 10A, 10B will be described in detail.

The flow-path part in the discharging head 10 is a laminated body including a plurality of laminated plates. The volume-changeable part includes a vibration board 155 and actuators 160 being piezoelectric devices. On the vibration board 155, an insulator film 156 is attached, and on the insulator film 156, a common electrode 161, which will be described further below, is attached.

The plurality of plates include a nozzle plate 146, a spacer plate 147, a first flow-path plate 148, a second flow-path plate 149, a third flow-path plate 150, a fourth flow-path plate 151, a fifth flow-path plate 152, a sixth flow-path plate 153, and a seventh flow-path plate 154, which are arranged in this recited order from bottom to top.

Each of the plurality of plates is formed to have holes and grooves in various sizes. The holes and the grooves in the plurality of plates that are stacked are combined to form ink paths including the plurality of nozzles 121, a plurality of individual flow paths 164, and a manifold 122, solely one of which is shown in FIG. 3.

The nozzles 121 are formed through the nozzle plate 146 in a stacked direction, in which the plurality of plates are stacked. On the discharging surface NM of the nozzle plate 146 the nozzle holes 121*a*, which form ends of the nozzles 121, align along the sub-scanning direction Df to form nozzle arrays.

The manifold 122 may supply the ink to pressure chambers 128, to which pressure by the ink being discharged is applied. The manifold 122 is elongated in the sub-scanning direction Df and is connected with each one end of the plurality of individual flow paths 164. In other words, the manifold 122 functions as a common flow path for the ink. The manifold 122 is formed of through holes bored through the first flow-path plate 148—the fourth flow-path plate 151 in the stacked direction and a recess carved upward from a lower surface of the fifth flow-path plate 152, which overlap in the stacked direction.

The nozzle plate 146 is located at a lower position with respect to the spacer plate 147. The spacer plate 147 may be made of, for example, stainless steel. The spacer plate 147 has a recessed portion 145, which is recessed in a direction of thickness of the spacer plate 147 from a surface facing the nozzle plate 146. The recessed portion 145 may be formed by, for example, half-etching to have a thinner part forming a damper portion 147*a* and a damper space 147*b*.

The manifold 122 is connected with a supply port 122*a*. The supply port 122*a* may be, for example, in a cylindrical form and is located at one end of the manifold 122 in the sub-scanning direction Df. The manifold 122 and the supply port 122*a* are connected through a flow path, which is not shown.

The plurality of individual flow paths 164 are each connected with the manifold 122. Each individual flow path 164 is connected with the manifold 122 at an upstream end thereof and with a basal end of one of the nozzles 121 at a downstream end thereof. The individual flow path 164 includes a first connecting hole 125, a supply funnel path 126 being an individual funnel path, a second connecting hole 127, a pressure chamber 128, and a descender 129, which are arranged in this recited order from upstream to downstream of a flow of the ink.

The first connecting hole 125 is, at a lower end thereof, connected to an upper end of the manifold 122 and extends upward in the stacked direction from the lower end through an upper part of the fifth flow-path plate 152.

The supply funnel path 126 is connected to an upper end of the first connecting hole 125 at an upstream end thereof. The supply funnel path 126 may consist of a groove carved by, for example, half-etching to be recessed upward from a lower face of the sixth flow-path plate 153. The second connecting hole 127 is connected to a downstream end of the supply funnel path 126 at an upstream end thereof and extends upward from the supply funnel path 126 in the stacked direction through the sixth flow-path plate 153 in the stacked direction.

The pressure chamber 128 is connected to a downstream end of the second connecting hole 127 at an upstream end thereof. The pressure chamber 128 is formed through the seventh flow-path plate 154 in the stacked direction.

The descender 129 is formed through the spacer plate 147, the first flow-path plate 148, the second flow-path plate 149, the third flow-path plate 150, the fourth flow-path plate 151, the fifth flow-path plate 152, and the sixth flow-path plate 153 in the stacked direction. The descender 129 is connected to a downstream end of the pressure chamber 128 at an upstream end thereof and to the basal end of the nozzle 121 at a downstream end thereof. The nozzle 121 overlaps the descender 129, for example, in the stacked direction and is located at a center of the descender 129 in the widthwise direction.

The vibration board 155 is stacked on the seventh flow-path plate 154 and covers an upper side of the pressure chamber 128.

The actuator 160 includes a common electrode 161, a piezoelectric layer 162, and an individual electrode 163, which are arranged in this recited order. The common electrode 161 covers the vibration board 155 entirely through the insulator film 156. The piezoelectric layer 162 is provided to each pressure chamber 128 and is arranged on the common electrode 161 to overlap the respective pressure chamber 128. The individual electrode 163 is provided to each pressure chamber 128 and is arranged on the piezoelectric layer 162. The single individual electrode 163, the common electrode 161, and the part of the piezoelectric layer 162 interposed between the individual electrode 163 and the common electrode 161 form a single actuator 160.

Each individual electrode 163 is connected electrically to a driver IC. The driver IC may receive controlling signals from a controller, which is not shown, generate driving signals (voltage signals), and apply the generated signals to the individual electrode 163. Meanwhile, the common electrode 161 is regularly maintained at the ground potential. Under this condition, in response to the driving signals being applied, an active part of the piezoelectric layer 162 may expand or contract in a planar direction thereof along with the individual electrode 163 and the common electrode 161. In response, the vibration board 155 may cooperatively deform to reduce or increase the volume of the pressure chamber 128. Thereby, discharging pressure to discharge the ink through the nozzle 121 may be applied to the pressure chamber 128.

In the discharging head 10 as described above, the ink may flow through the supply port 122*a* to the manifold 122, from the manifold 122 through the first connecting hole 125 to the supply funnel path 126, and from the supply funnel path 126 through the second connecting hole 127 to the pressure chamber 128. Further, the ink may flow through the descender 129 to the nozzle 121. Meanwhile, the actuator 160 may apply the discharging pressure to the pressure chamber 128, and the ink may be discharged through the nozzle hole 121*a*.

Figure 4:
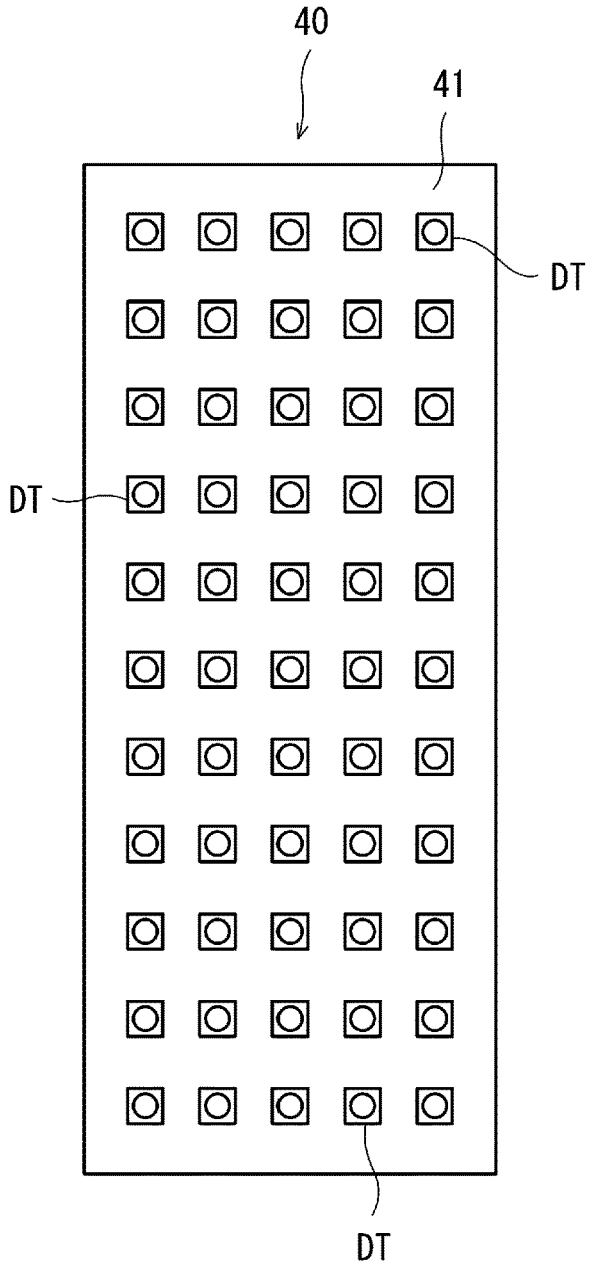
FIG. 4 is an illustrative view of light-emitting diode chips in an ultraviolet irradiation device in the image recording apparatus according to the embodiment of the present disclosure.
Figure 4:
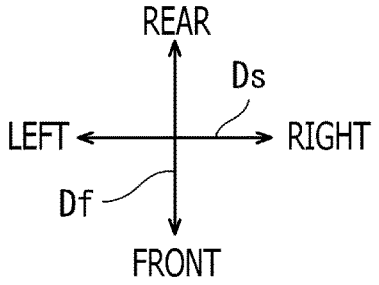

Next, with reference to FIG. 4, light-emitting diode chips DT in the UV irradiation device 40 will be described in this paragraph. As shown in FIG. 4, the UV irradiation device 40 has a supporting board 41 and a plurality of light-emitting diode chips DT, which may emit ultraviolet rays, arranged on the supporting board 41. The light-emitting diode chips DT function as a light source and emit the ultraviolet rays, which may cure the ink discharged from the discharging head 10. The light-emitting diode chips DT are semiconductor devices that may generate the ultraviolet rays. Each light-emitting diode chip DT is regularly arranged at predetermined intervals, for example, in the main scanning direction Ds and the sub-scanning direction Df, respectively. The light-emitting diode chips DT may be arranged in, for example, a matrix.

Figure 5:
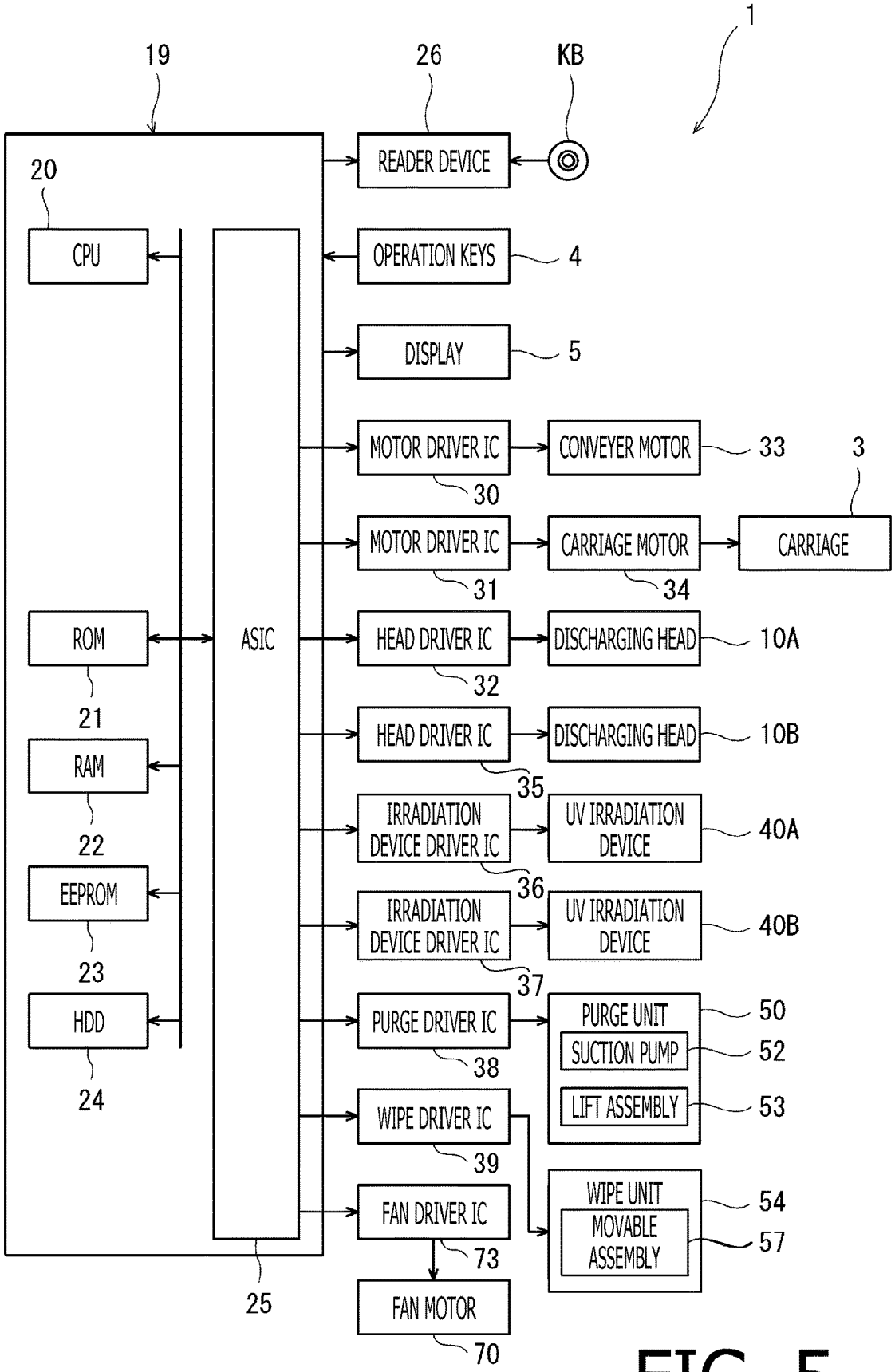
FIG. 5 is a block diagram to illustrate components in the image recording apparatus according to the embodiment of the present disclosure.

Next, components in the image recording apparatus 1 according to the present embodiment will be described with reference to the block diagram shown in FIG. 5. As shown in FIG. 5, the image recording apparatus 1 of the present embodiment includes, further to the components described above, a controller 19, a reader device 26, motor driver ICs 30, 31, head driver ICs 32, 35, a conveyer motor 33, a carriage motor 34, irradiation device driver ICs 36, 37, a purge driver IC 38, a wipe driver IC 39, a fan driver IC 73, and a fan motor 70.

The controller 19 has a CPU 20, storages including a ROM 21, a RAM 22, an EEPROM 23, an HDD 24, and an ASIC 25. The CPU 20 is a controlling device in the image recording apparatus 1 and is connected with the storages. The CPU 20 may control the driver ICs 30-32, 35-39, 73, and the display 5.

The CPU 20 may execute an image recording program stored in the ROM 21 to implement various functions. The CPU 20 may be mounted in the controller 19 as a single processer or may include a plurality of processors that may cooperate with one another. The image recording program may be read by the reader device 26 from a recordable medium KB such as, for example, a computer-readable optical magnetic disk or a USB flash memory. The RAM 22 may store results of computation by the CPU 20. The EEPROM 23 may store information concerning initial settings input by a user. The HDD 24 may store specific information.

To the ASIC 25, the motor driver ICs 30, 31, the head driver ICs 32, 35, the irradiation device driver ICs 36, 37, the purge driver IC 38, the wipe driver 39, and the fan driver IC 73 are connected. The CPU 20 may receive a print job from the user and output an image recording command to the ASIC 25 according to the image recording program. The ASIC 25 may activate the drivers ICs 30-32, 35-39, 73 according to the image recording command. The CPU 20 may drive the conveyer motor 33 through the motor driver IC 30 to move the platen 6 in the sub-scanning direction Df. The CPU 20 may drive the carriage motor 34 through the motor driver IC 31 to move the carriage 3 in the main scanning direction Ds. The CPU 20 may control the head driver ICs 32, 35 to discharge the inks through the discharging heads 10A, 10B. The CPU 20 may activate the irradiation device driver ICs 36, 37 to control the light-emitting diode chips DT in the UV irradiation devices 40A, 40B to emit the ultraviolet rays. The CPU 20 may drive the suction pump 52 in the purge unit 50 and the lift assembly 53 through the purge driver IC 38. The CPU 20 may drive the movable assembly 57 in the wipe unit 54 through the wipe driver IC 39. The CPU 20 may control a fan 74, which will be described further below, by driving the fan motor 70 through the fan driver IC 73. Control by the CPU 20 over a rotation speed of the fan 74 will be described further below.

Figure 6A:
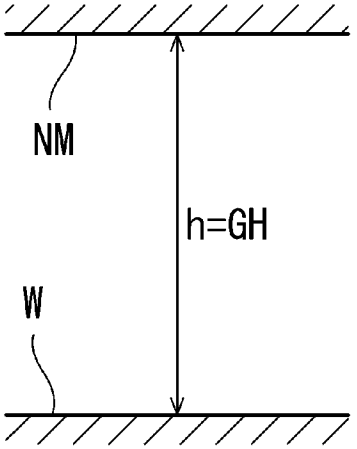
FIG. 6A illustrates a distance between a platen and nozzles being a high gap in the image recording apparatus according to the embodiment of the present disclosure. FIG.
Figure 6B:
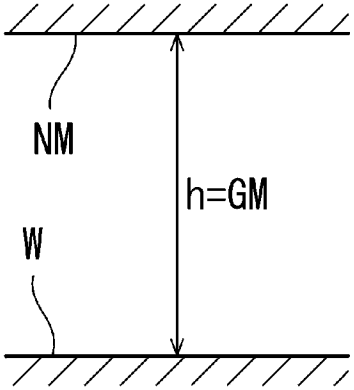
FIG. 6C illustrates the distance between the platen and the nozzles being a low gap in the image recording apparatus according to the embodiment of the present disclosure.
Figure 6C:
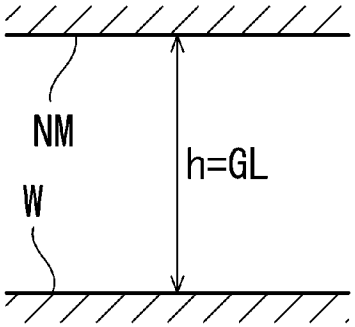

FIGS. 6A-6C illustrate a distance h between the printable medium W and the discharging surface NM of the nozzles 121. FIG. 6A illustrates a high gap GH, which is the maximum distance h between the printable medium W and the discharging surface NM. FIG. 6B illustrates a low gap GL, which is the minimum distance h between the printable medium W and the discharging surface NM. Distances h between the printable medium W and the discharging surface NM larger than the low gap GL and smaller than the high gap GH will be called as a middle gap GM. The high gap GH may be, for example, 18 mm. The low gap GL may be, for example, 2 mm A printing mode when the distance h is the high gap GH will be called as a high-gap printing mode, a printing mode when the distance h is the low gap GL will be called as a low-gap printing mode, and a printing mode when the distance h is the middle gap GM will be called as a middle-gap printing mode. A print job includes information instructing one of the printing modes among the high-gap printing mode, in which an image is printed with the high gap GH, the middle-gap printing mode, in which an image is printed with the middle gap GM, and the low-gap printing mode, in which an image is printed with the low gap GL.

Figure 7:
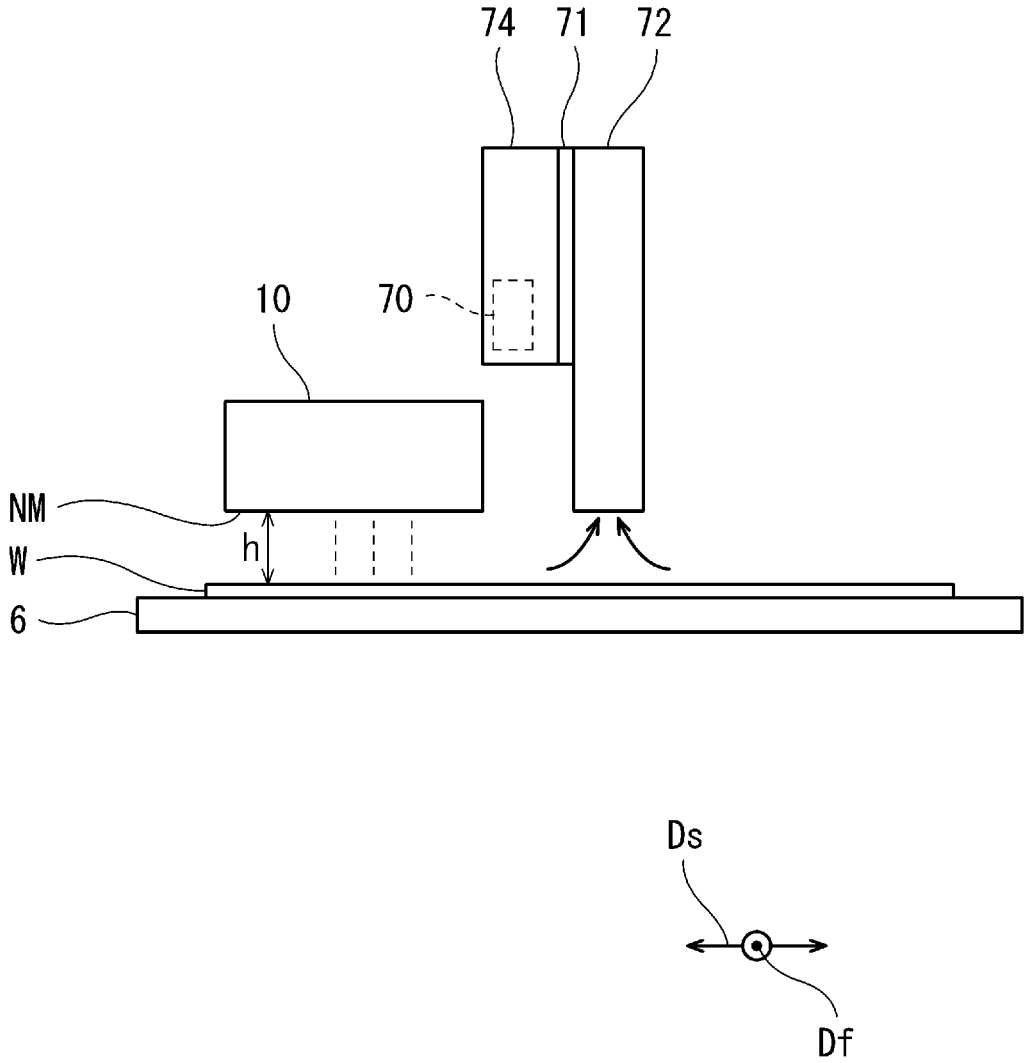
FIG. 7 is an illustrative view of the discharging head and a fan located nearby the discharging head in the image recording apparatus according to the embodiment of the present disclosure.

Next, the fan 74 is described with reference to FIG. 7. As shown in FIG. 7, the fan 74 is located on one side of the discharging head 10 in the main scanning direction Ds. The fan 74 may be driven to rotate by driving the fan motor 70. On one side of the fan 74 in the main scanning direction Ds, a duct 72 is arranged. An upstream opening of the duct 72 is provided at a lower end of the duct 72, and a filter 71 is provided between the upstream opening and a downstream opening. In this configuration, when the discharging head 10 discharges the ink through the nozzles 121, the controller 19 may drive the fan motor 70, and the fan 74 may generate an airflow to collect mist of the ink being discharged. When the airflow is generated by the fan 74, the mist may be suctioned through the upstream opening of the duct 72 and caught by the filter 71. The mist may be thus collected with use of the fan 74 by the controller 19 controlling the rotation speed of the fan motor 70 based on a size of the droplets of the ink to be discharged and the distance h between the printable medium W and the discharging surface NM of the nozzles 121. The control of the rotation speed by the controller 19 will be described further in detail in the following paragraphs.

Figure 8:
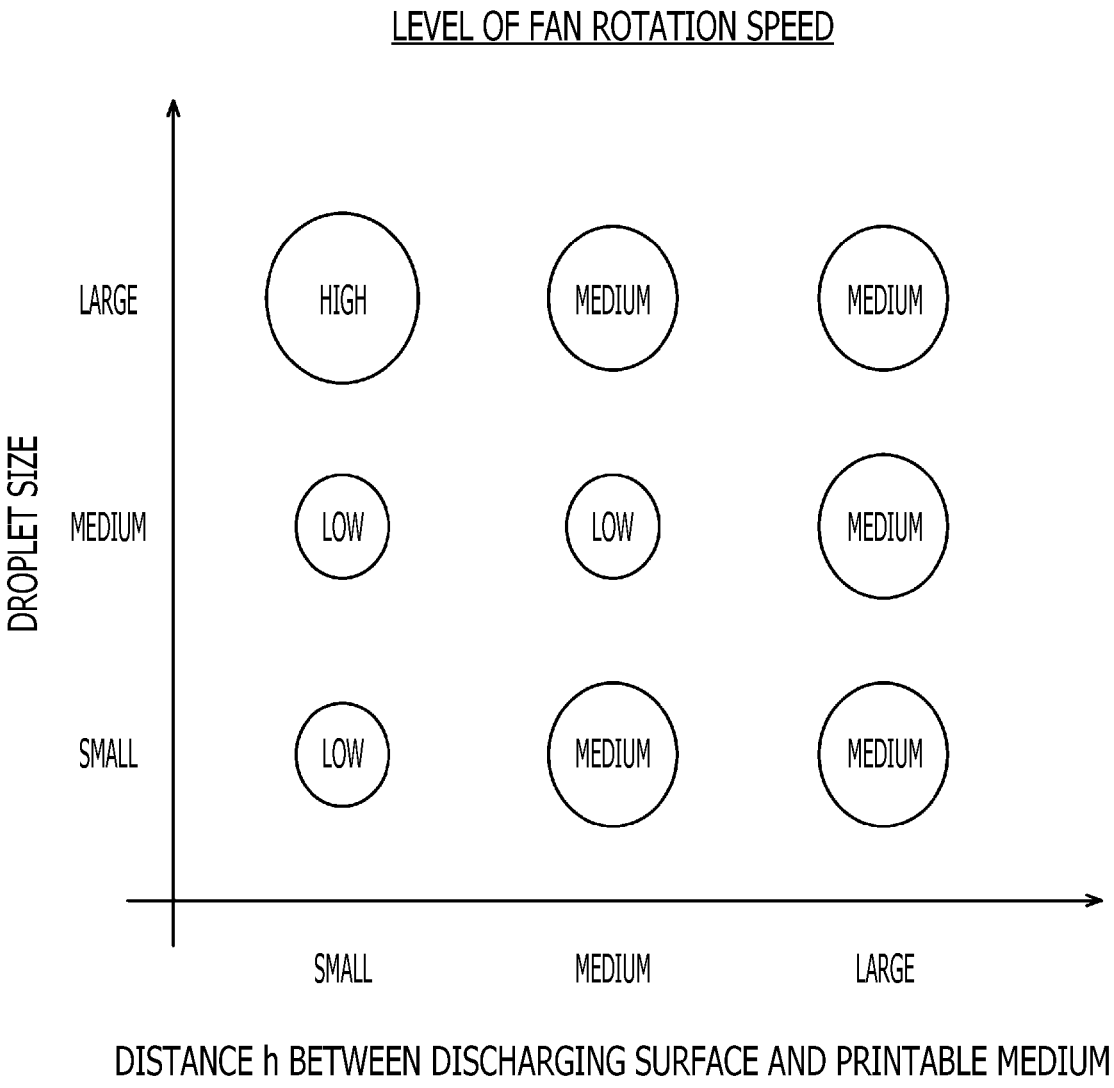
FIG. 8 illustrates levels of rotation speeds of the fan that are variable in relation to a distance, which is between a discharging surface and a printable medium, and a droplet size, according to the embodiment of the present disclosure.

FIG. 8 illustrates levels of the rotation speed of the fan 74, which are variable in relation to the distance h, which is between the discharging surface NM and the printable medium W, and a size of the droplets of the ink being discharged.

In the present embodiment, the controller 19 obtains the size of droplets of the ink to be discharged through the nozzles 121 from the print job transmitted to the image recording apparatus 1. Alternately, the controller 19 may obtain the droplet size from the printing mode set in advance by the user. Further, the controller 19 obtains the distance h between the discharging surface NM and the printable medium W. The controller 19 may obtain the distance h based on a height of the platen 6 set by the user and a thickness of the printable medium W.

The controller 19 determines a level of the rotation speed of the fan motor 70 in relation to the distance h, which is between the discharging surface NM and the printable medium W, and the droplet size, as shown in FIG. 8. The controller 19 may determine the droplet size to be one of predetermined different classes, which are large, medium, and small. Moreover, the controller 19 may determine the distance h to be one of predetermined different classes, which are large, medium, and small. Further, the controller 19 may determine the rotation speed of the fan motor 70 to be one of predetermined different classes, which are high, medium, and low, based on the largeness of the droplet size and the largeness of the distance h and controls the rotation speed. The control of the rotation speed by the controller 19 will be described further below with reference to FIG. 8.

When the distance h is small, the level of the fan motor 70 to be driven may be determined in one of the following three (3) controls. As shown in FIG. 8, when the droplet size is small, and the distance h is small, the controller 19 may determine the rotation speed of the fan motor 70 to be low. When the droplet size is medium, and the distance h is small, the controller 19 may determine the rotation speed of the fan motor 70 to be low. When the droplet size is large, and the distance h is small, the controller 19 may determine the rotation speed of the fan motor 70 to be high.

When the distance h is medium, the level of the fan motor 70 to be driven may be determined in one of the following three (3) controls. As shown in FIG. 8, when the droplet size is small, and the distance h is medium, the controller 19 may determine the rotation speed of the fan motor 70 to be medium. When the droplet size is medium, and the distance h is medium, the controller 19 may determine the rotation speed of the fan motor 70 to be low. When the droplet size is large, and the distance h is medium, the controller 19 may determine the rotation speed of the fan motor 70 to be medium.

When the distance h is large, the level of the fan motor 70 to be driven may be determined in one of the following three (3) controls. As shown in FIG. 8, when the droplet size is small, and the distance h is large, the controller 19 may determine the rotation speed of the fan motor 70 to be medium. When the droplet size is medium, and the distance h is large, the controller 19 may determine the rotation speed of the fan motor 70 to be medium. When the droplet size is large, and the distance h is large, the controller 19 may determine the rotation speed of the fan motor 70 to be medium. In other words, when the distance h is large, the rotation speed of the motor 70 is determined to be medium regardless of the droplet size.

A basic principle of the control described above in the embodiment is summarized in this and next paragraphs. When the droplet size is large and the distance h is large, the mist may be generated easily, and the mist may need to be collected intensively. However, behavior of the droplets aimed at the printable medium W may likely be affected by the airflow due to the distance h being large. Therefore, the rotation speed of the fan motor 70 is set to be medium rather than high. Meanwhile, when the droplet size is large and the distance h is small, the mist may be generated easily, but a time period, in which the droplets may be affected by the airflow, is shorter. Therefore, the rotation speed of the fan motor 70 is set to be high.

On the other hand, when the droplet size is small and the distance h is larger, the discharged droplets may turn into mist before landing on the printable medium W. Therefore, the rotation speed of the fan motor 70 may be set to medium or high to collect the mist. When the droplet size is small and the distance h is small, the mist may not be generated easily. Therefore, although the time period, in which the droplets may be affected by the airflow, may be short, the rotation speed of the fan motor 70 may be set to be low in the light of noise reduction.

Figure 9:
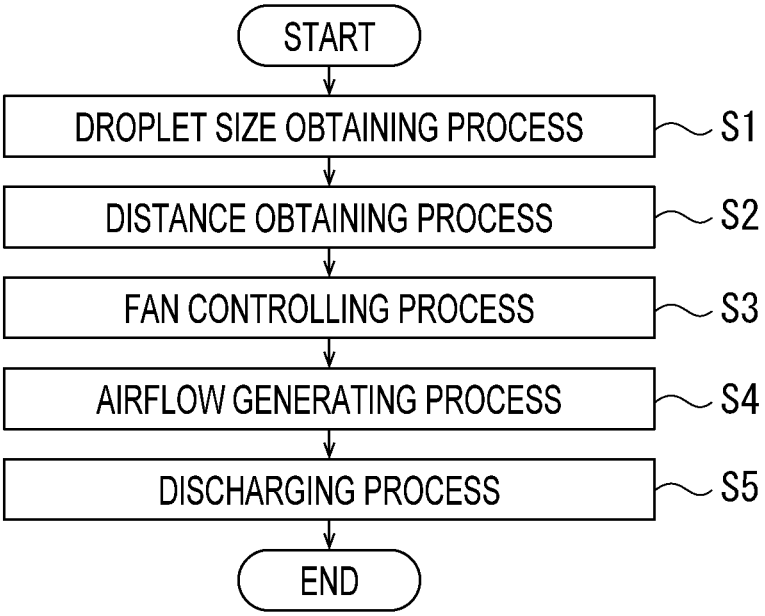
FIG. 9 is a flowchart to illustrate a flow of steps in an image recording method according to the embodiment of the present disclosure.

Next, the image recording method according to the present embodiment will be described with reference to the flowchart shown in FIG. 9.

A flow of steps to generate an airflow by the fan 74 prior to discharging the ink will be described below. As shown in FIG. 9, the controller 19 obtains a droplet size of the ink to be discharged from the discharging head 10 from, for example, a print job (droplet size obtaining process: S1). Thereafter, the controller 19 obtains the distance h between the discharging surface NM of the discharging head 10 and the printable medium W (distance obtaining process: S2).

Next, the controller 19 controls the rotation speed of the fan motor 70 based on the droplet size and the distance h obtained in S2 (fan controlling process: S3). Next, the controller 19 controls the fan 74 to generate an airflow to collect the mist of the ink discharged from the discharging head 10 (airflow generating process: S4). Thereafter, the controller 19 controls the discharging head 10 to move and discharge the ink, which may be, for example, the UV-curable ink, from the discharging head 10 (discharging process: S5).

As described above, according to the image recording apparatus 1 in the present embodiment, the rotation speed of the fan motor 70 is controlled by the controller 19 based on the droplet size and the distance between the printable medium W and the discharging surface NM. Thus, the mist caused by the ink discharged through the nozzles 121 may be efficiently collected. Thereby, unpreferable situations where, for example, discharged smaller droplets float in the air without landing on the intended positions and where, for another example, when the distance h is larger, a large amount of mist stays over the printable medium W, may be restrained compared to the conventional configuration. Accordingly, an unpreferable result that the printing quality is lowered by the mist adhered to the printable medium W may be avoided.

According to the embodiment described above, the controller 19 may determine the droplet size to be one of large, medium, and small and the distance h to be one of large, medium, and small to determine the rotation speed of the fan motor 70 to be one of high, medium, and low. Thus, the rotation speed of the fan motor 70 may be determined based on the condition of the droplet size, which is not only either large or small but also may be medium, and the condition of the distance h, which is not only either large or small but also may be medium. Therefore, the rotation speed of the fan motor 70 may be controlled more finely based on the droplet size and the distance h, and the mist may be collected efficiently.

According to the embodiment described above, the controller 19 determines the rotation speed of the fan motor 70 to be low when the droplet size is small and the distance h is small. Because of the droplet size being small, an amount of the mist that may be generated may be relatively small, and because of the distance h being small, a time period, in which the droplets may be affected by the airflow, may be relatively short. Therefore, the rotation speed of the fan motor 70 may be controlled to be low so that noise may be reduced.

According to the embodiment described above, the controller 19 determines the rotation speed of the fan motor 70 to be high when the droplet size is large and the distance h is small. Because of the droplet size being large, mist may likely be generated, but because of the distance h being small, a time period, in which the droplets may be affected by the airflow, may be relatively short. Therefore, the rotation speed of the fan motor 70 may be controlled to be large so that the mist may be efficiently collected.

According to the embodiment described above, the controller 19 determines the rotation speed of the fan motor 70 to be medium when the droplet size is large and the distance h is large. Because of the droplet size being large, mist may likely be generated, but because of the distance h being large, a time period, in which the droplets may be affected by the airflow, may be relatively long. Therefore, the rotation speed of the fan motor 70 may be controlled to be medium so that the mist may be efficiently collected.

According to the embodiment described above, the controller 19 determines the rotation speed of the fan motor 70 to be medium when the droplet size is small and the distance h is large. Because of the droplet size being small and the distance h being large, the discharged droplets may likely turn into mist without landing on the printable medium W. Therefore, the rotation speed of the fan motor 70 may be controlled to be medium so that the mist may be efficiently collected.

According to the embodiment described above, the controller 19 determines the rotation speed of the fan motor 70 to be high when the droplet size is large and the distance h is small. Because of the droplet size being large, mist may likely be generated, but because of the distance h being small, a time period, in which the droplets may be affected by the airflow, may be relatively short. Therefore, the rotation speed of the fan motor 70 may be controlled to be high so that the mist may be efficiently collected.

More Examples

Although an example of carrying out the invention has been described, those skilled in the art will appreciate that there are numerous variations and permutations of the image recording apparatus, the method for image recording, and the computer-readable storage medium storing computer-readable instructions for image recording that fall within the spirit and the scope of the invention as set forth in the appended claims. It is to be understood that the subject matter defined in the appended claims is not necessarily limited to the specific features or act described above. Rather, the specific features and acts described above are disclosed as example forms of implementing the claims. In the meantime, the terms used to represent the components in the above embodiment may not necessarily agree identically with the terms recited in the appended claims, but the terms used in the above embodiments may merely be regarded as examples of the claimed subject matters.

For example, the actuators 160 may not necessarily be configured with the piezoelectric devices but may employ a different type of actuators such as thermal actuators.

Figure 10:
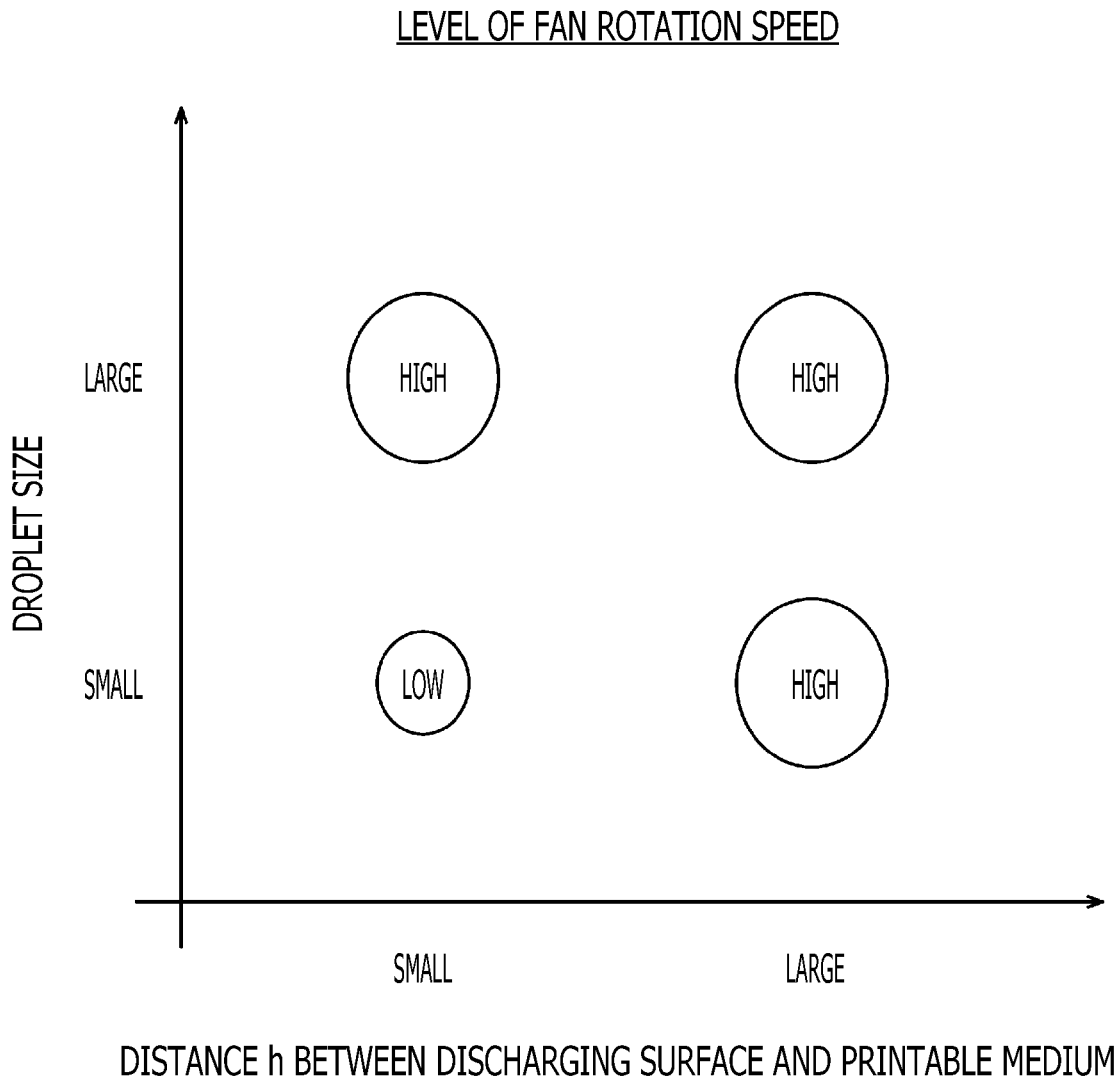
FIG. 10 is a first modified example to illustrate levels of rotation speeds of the fan that are variable in relation to a distance, which is between the discharging surface and the printable medium, and the droplet size, according to the embodiment of the present disclosure.

For another example, the controller 19 may not necessarily determine the rotation speed of the fan motor 70 among high, medium, and low based on determination of the droplet size, which may be one of large, medium, and small, and determination of the distance h, which may be one of large, medium and small. As shown in FIG. 10, the controller 19 may determine the droplet size to be either large or small and the distance h to be either large or small, and determine the rotation speed of the fan motor 70 to be either high or low based on the droplet size and the distance h having been determined. For another example, the controller 19 may determine the droplet size to be either large or small and determine the rotation speed of the fan motor 70 to be either high or low based on the droplet size having been determined. For another example, the controller 19 may determine the distance h to be either large or small and determine the rotation speed of the fan motor 70 to be either high or low based on the distance h having been determined.

For another example, the fan motor 70 may not necessarily be controlled by the controller 19 according to the flow of processes described above and shown in FIG. 8 but may be controlled, for example, in a manner described below.

Figure 11:
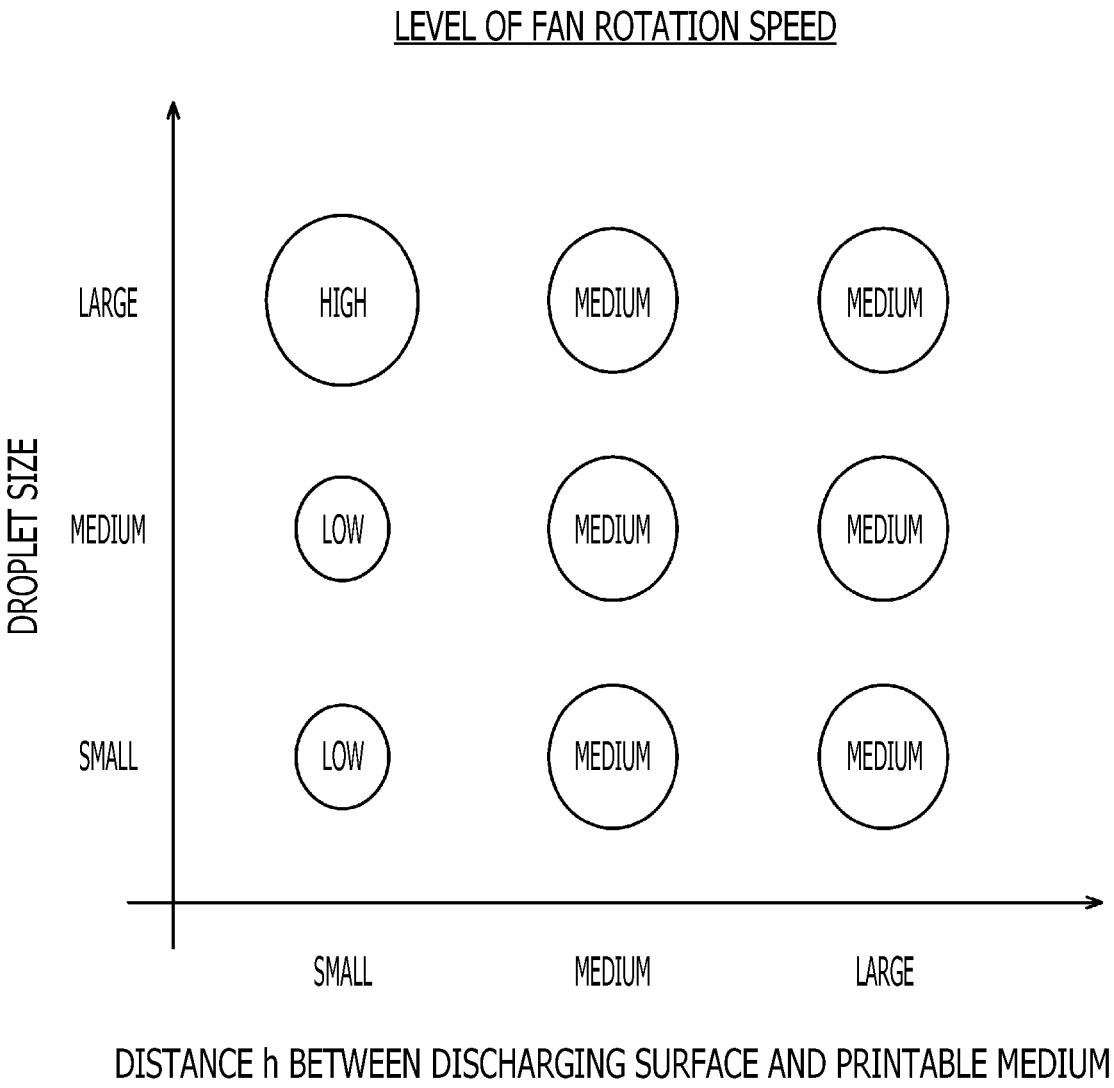
FIG. 11 is a second modified example to illustrate levels of rotation speeds of the fan that are variable in relation to a distance, which is between the discharging surface and the printable medium, and the droplet size, according to the embodiment of the present disclosure.

For example, the "low" rotation speed of the fan motor 70 shown in FIG. 8 in the case where the distance h is medium and the droplet size is medium may be replaced with "medium" rotation speed as shown in FIG. 11. For another example, the "medium" rotation speed of the fan motor 70 shown in FIG. 11 in the case where the distance h is large and the droplet size is small, may be replaced with "high" rotation speed. For another example, the "medium" rotation speed of the fan motor 70 shown in FIG. 11 in the case where the distance h is large and the droplet size is small may be replaced with "high" rotation speed, and, further, the "low" rotation speed of the fan motor 70 shown in FIG. 11 in the case where the distance h is small and the droplet size is medium may be replaced with the "medium" rotation speed. For another example, the "medium" rotation speed of the fan motor 70 shown in FIG. 11 in the case where the distance h is large and the droplet size is small may be replaced with the "high" rotation speed, and the "low" rotation speed of the fan motor 70 shown in FIG. 11 in the case where the distance h is small and the droplet size is medium may be replaced with the "medium" rotation speed; and, further, the "medium" rotation speed of the fan motor 70 shown in FIG. 11 in the case where the distance h is large and the droplet size is medium may be replaced with the "high" rotation speed, and the "medium" rotation speed of the fan motor 70 shown in FIG. 11 in the case where the distance h is medium and the droplet size is large may be replaced with the "high" rotation speed.

Figure 12:
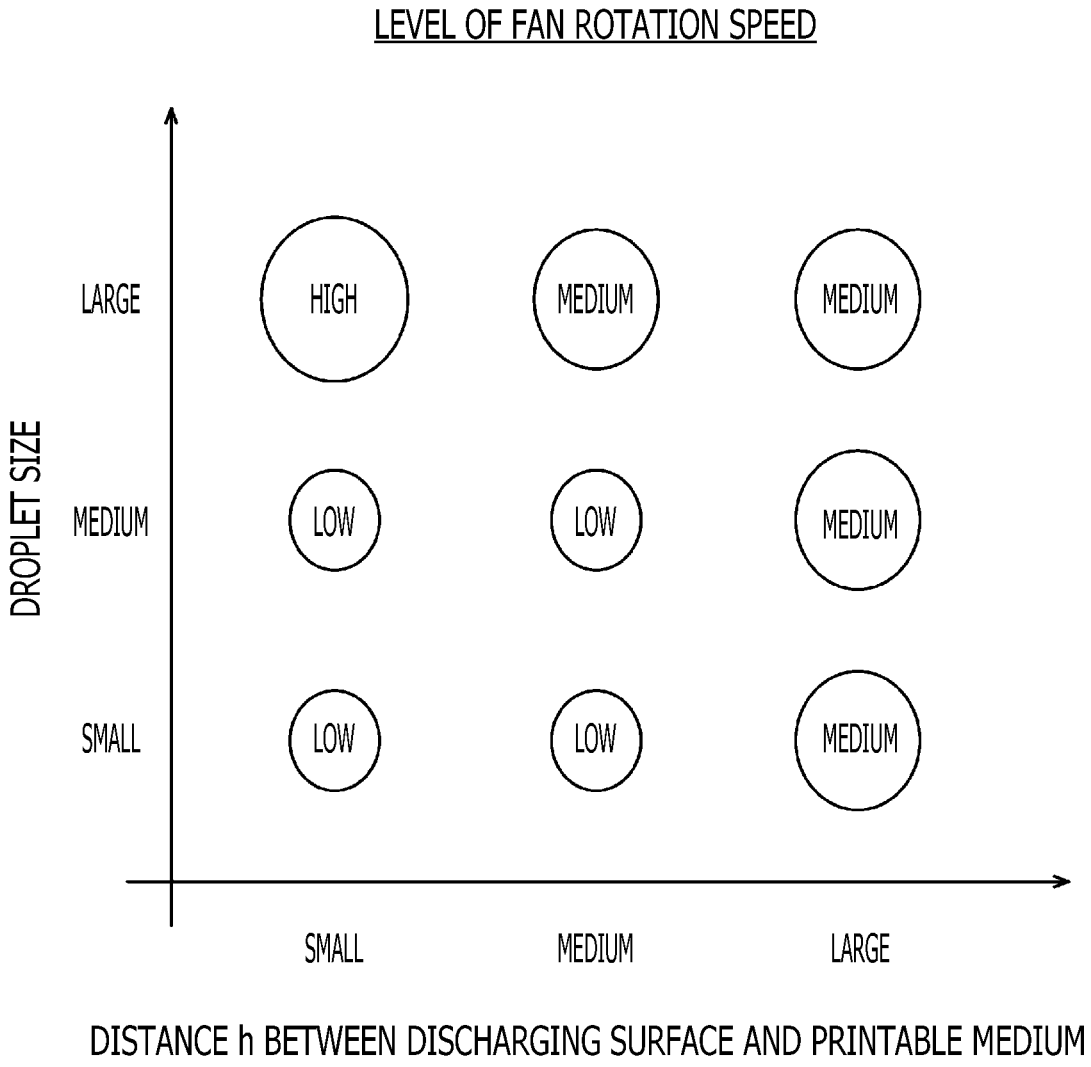
FIG. 12 is a third modified example to illustrate levels of rotation speeds of the fan that are variable in relation to a distance, which is between the discharging surface and the printable medium, and the droplet size, according to the embodiment of the present disclosure.

For another example, the "medium" rotation speed of the fan motor 70 shown in FIG. 8 in the case where the distance h is medium and the droplet size is small may be replaced with the "low" rotation speed as shown in FIG. 12.

Figure 13:
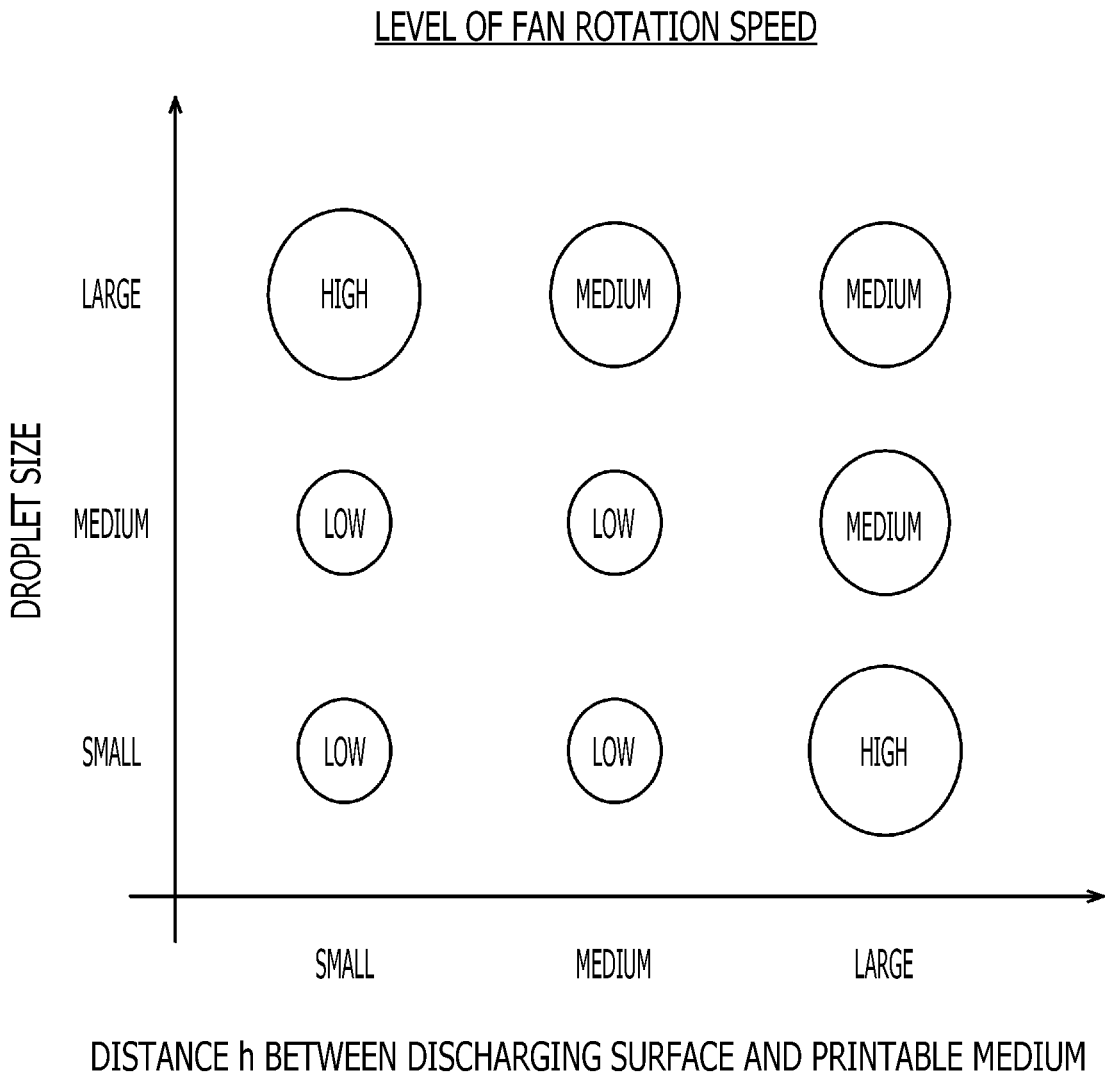
FIG. 13 is a fourth modified example to illustrate levels of rotation speeds of the fan that are variable in relation to a distance, which is between the discharging surface and the printable medium, and the droplet size, according to the embodiment of the present disclosure.

For another example, the "medium" rotation speed of the fan motor 70 shown in FIG. 8 in the case where the distance h is medium and the droplet size is small may be replaced with the "low" rotation speed as shown in FIG. 13, and the "medium" rotation speed of the fan motor 70 shown in FIG. 8 in the case where the distance h is large and the droplet size is small may be replaced with the "high" rotation speed as shown in FIG. 13. For another example, the "low" rotation speed of the fan motor 70 shown in FIG. 13 in the case where the distance h is medium and the droplet size is medium may be replaced with the "medium" rotation speed, and the "low" rotation speed of the fan motor 70 shown in FIG. 13 in the case where the distance h is small and the droplet size is medium may be replaced with the "medium" rotation speed.

Figure 14:
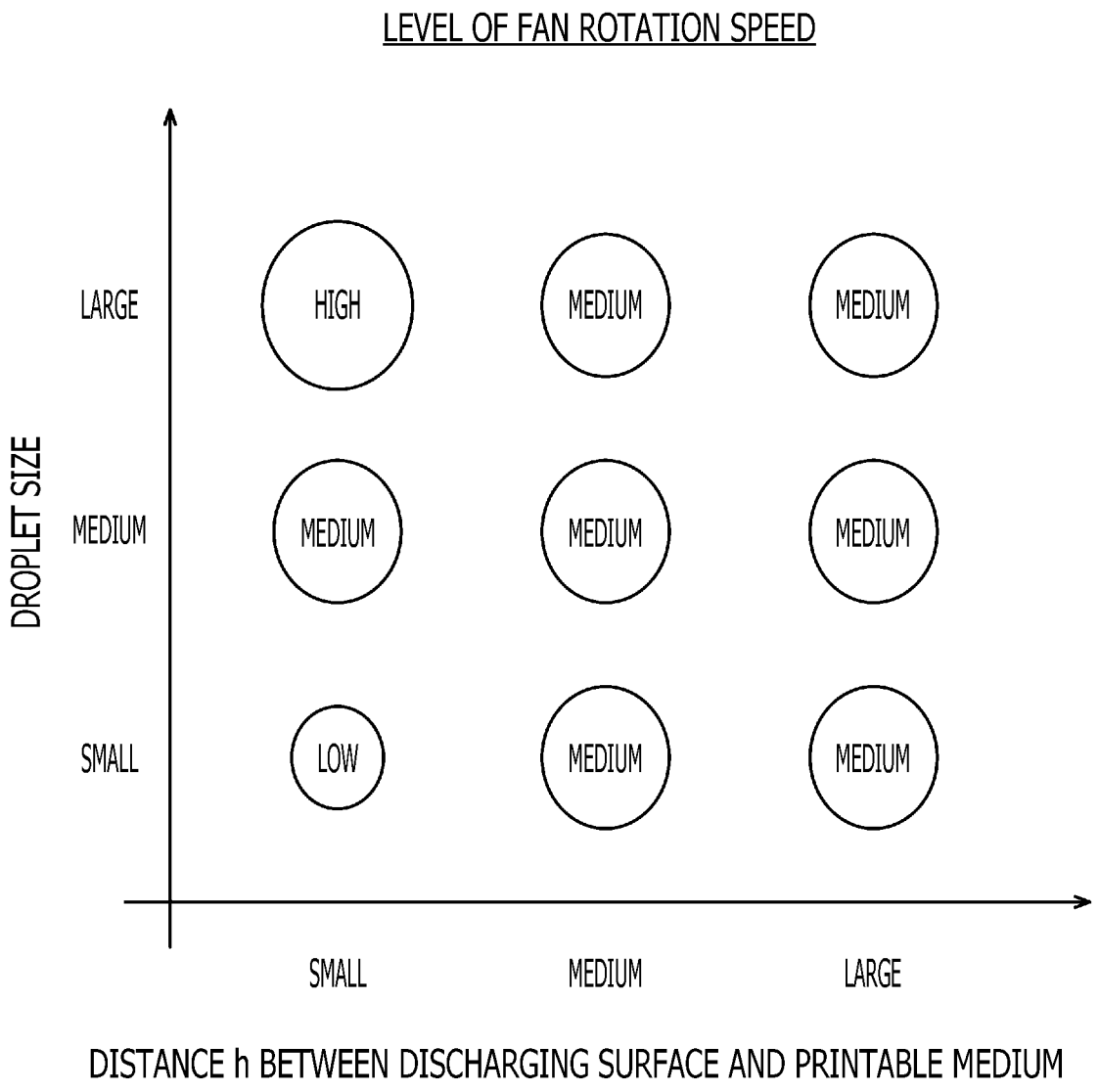
FIG. 14 is a fifth modified example to illustrate levels of rotation speeds of the fan that are variable in relation to a distance, which is between the discharging surface and the printable medium, and the droplet size, according to the embodiment of the present disclosure.

For another example, the "low" rotation speed of the fan motor 70 shown in FIG. 8 in the case where the distance h is medium and the droplet size is medium may be replaced with the "medium" rotation speed as shown in FIG. 14, and the "low" rotation speed of the fan motor 70 shown in FIG. 8 in the case where the distance h is small and the droplet size is medium may be replaced with the "medium" rotation speed as shown in FIG. 14. For another example, the "medium" rotation speed of the fan motor 70 shown in FIG. 14 in the case where the distance h is large and the droplet size is small may be replaced with the "high" rotation speed.

For another example, the controller 19 may not necessarily determine the rotation speed of the fan motor 70 in the case where the droplet size is small and the distance h is large to be medium but may be determined the rotation speed of the fan motor 70 to be high.

For another example, the amounts of the high gap GH and the low gap GL may not necessarily be limited to 18 mm and 2 mm, respectively, as long as the low gap GL is smaller than the high gap GH.

For another example, the controller 19 may not necessarily determine the rotation speed of the fan motor 70 stepwise based on the droplet size in the scale of three, which are large, medium, and small, but may control the rotation speed of the fan motor 70 continuously in proportion to a continuously changeable droplet size. In other words, determining the droplet size to one between a large size and a small size and determining a level of the rotation speed of the fan based on the determined droplet size includes changing the rotation speed of the fan continuously in proportion to the droplet size.

For another example, the controller 19 may not necessarily determine the rotation speed of the fan motor 70 stepwise based on the distance h in the scale of three, which are large, medium, and small, but may control the rotation speed of the fan motor 70 continuously in proportion to a continuously changeable distance. In other words, determining the distance to one between a large distance and a small distance and determine a level of the rotation speed of the fan based on the determined distance includes changing the rotation speed of the fan continuously in proportion to the distance.

For another example, the discharging head 10 may not necessarily include two (2) discharging heads 10A, 10B but may have a single discharging head 10 alone, and the UV irradiation device 40 may not necessarily include two (2) UV irradiation devices 40A, 40B but may have a single UV irradiation device 40 alone.

What is claimed is:

1. An image recording apparatus, comprising:

a discharging head including a discharging surface and a plurality of nozzles arranged along a sub-scanning direction, the sub-scanning direction intersecting orthogonally with a main scanning direction, the discharging head being configured to move in the main scanning direction;

a fan configured to generate an airflow for collecting mist of ink discharged through the nozzles; and a controller configured to:

obtain a droplet size of the ink to be discharged through the nozzles from one of a print job and a printing mode set in advance;

obtain a distance between the discharging surface and a printable medium; and control a rotation speed of the fan based on the droplet size and the distance.

2. The image recording apparatus according to claim 1, wherein the controller is configured to determine the obtained droplet size to be one of large and small and determine the rotation speed of the fan to be one of high and low based on largeness of the droplet size.

3. The image recording apparatus according to claim 1, wherein the controller is configured to determine the obtained distance to be one of large and small and determine the rotation speed of the fan to be one of high and low based on largeness of the distance.

4. The image recording apparatus according to claim 1, wherein the controller is configured to:

determine the obtained droplet size to be one of large and small;

determine the obtained distance to be one of large and small; and determine the rotation speed of the fan to be one of high and low based on largeness of the droplet size and largeness of the distance.

5. The image recording apparatus according to claim 4, wherein the controller determines the rotation speed of the fan to be low when the droplet size is small and the distance is small.

6. The image recording apparatus according to claim 4, wherein the controller determines the rotation speed of the fan to be high when the droplet size is large and the distance is small.

7. The image recording apparatus according to claim 1, wherein the controller is configured to:

determine the obtained droplet size to be one of large, medium, and small;

determine the obtained distance to be one of large, medium, and small; and determine the rotation speed of the fan to be one of high, medium, and low based on largeness of the droplet size and largeness of the distance.

8. The image recording apparatus according to claim 7, wherein the controller determines the rotation speed of the fan to be medium when the droplet size is large and the distance is large.

9. The image recording apparatus according to claim 7, wherein the controller determines the rotation speed of the fan to be one of medium and large when the droplet size is small and the distance is large.

10. The image recording apparatus according to claim 1, wherein the ink includes an ultraviolet-curable ink, and wherein the image recording apparatus further comprises a light source configured to emit an ultraviolet ray for curing the ultraviolet-curable ink.

11. A method for recording an image in an image recording apparatus comprising a discharging head including a discharging surface, the method comprising:

operating the discharging head to move and discharge ink;

operating a fan to generate an airflow for collecting mist of the ink discharged from the discharging head;

obtaining a droplet size of the ink to be discharged from the discharging head from one of a print job and a printing mode set in advance;

obtaining a distance between the discharging surface and a printable medium; and controlling a rotation speed of the fan based on the droplet size and the distance.

12. The method according to claim 11, wherein, for controlling the rotation speed of the fan, the obtained droplet size is determined to be one of large and small, and the rotation speed of the fan is determined to be one of high and low based on largeness of the droplet size.

13. The method according to claim 11, wherein, for controlling the rotation speed of the fan, the obtained distance is determined to be one of large and small, and the rotation speed of the fan is determined to be one of high and low based on largeness of the distance.

14. The method according to claim 11, wherein, for controlling the rotation speed of the fan, the obtained droplet size is determined to be one of large and small, the obtained distance is determined to be one of large and small, and the rotation speed of the fan is determined to be one of high and low based on largeness of the droplet size and largeness of the distance.

15. The method according to claim 11, wherein, for controlling the rotation speed of the fan, the obtained droplet size is determined to be one of large, medium, and small;

the obtained distance is determined to be one of large, medium, and small; and the rotation speed of the fan is determined to be one of high, medium, and low based on largeness of the droplet size and largeness of the distance.

16. A non-transitory computer readable storage medium storing computer readable instructions that are executable by a computer configured to control an image recording apparatus, the image recording apparatus comprising a discharging head including a discharging surface and a plurality of nozzles arranged along a sub-scanning direction, the sub-scanning direction intersecting orthogonally with a main scanning direction, the discharging head being configured to move in the main scanning direction, and a fan configured to generate an airflow for collecting mist of ink discharged through the nozzles, the computer readable instructions, when executed by the computer, causing the computer to:

obtain a droplet size of the ink to be discharged through the nozzles from one of a print job and a printing mode set in advance;

obtain a distance between the discharging surface and a printable medium; and control a rotation speed of the fan based on the droplet size and the distance.

17. The non-transitory computer readable storage medium according to claim 16, wherein, for controlling the rotation speed of the fan, the computer readable instructions, when executed by the computer, cause the computer to:

determine the obtained droplet size to be one of large and small;

determine the obtained distance to be one of large and small; and determine the rotation speed of the fan to be one of high and low based on largeness of the droplet size and largeness of the distance.

18. The non-transitory computer readable storage medium according to claim 16, wherein, for controlling the rotation speed of the fan, the computer readable instructions, when executed by the computer, cause the computer to:

determine the obtained droplet size to be one of large, medium, and small;

determine the obtained distance to be one of large, medium, and small; and determine the rotation speed of the fan to be one of high, medium, and low based on largeness of the droplet size and largeness of the distance.

* * * * *